US009400000B2

(12) United States Patent
Wang

(10) Patent No.: US 9,400,000 B2
(45) Date of Patent: Jul. 26, 2016

(54) BLOWER FAN

(71) Applicant: Sunonwealth Electric Machine Industry Co., Ltd., Kaohsiung (TW)

(72) Inventor: Ko-Chien Wang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 352 days.

(21) Appl. No.: 13/897,484

(22) Filed: May 20, 2013

(65) Prior Publication Data

US 2014/0010681 A1 Jan. 9, 2014

(30) Foreign Application Priority Data

Jul. 9, 2012 (TW) ..... 101124648 A

(51) Int. Cl.

| | |
|---|---|
| ***F04D 29/70*** | (2006.01) |
| ***F04D 17/08*** | (2006.01) |
| ***F04D 25/06*** | (2006.01) |
| ***F04D 25/08*** | (2006.01) |
| ***F04D 29/40*** | (2006.01) |
| ***F04D 29/42*** | (2006.01) |

(52) U.S. Cl.

CPC ..... *F04D 29/703* (2013.01); *F04D 17/08* (2013.01); *F04D 25/06* (2013.01); *F04D 25/0613* (2013.01); *F04D 25/08* (2013.01); *F04D 29/403* (2013.01); *F04D 29/4206* (2013.01); *F04D 29/4213* (2013.01); *F04D 29/4226* (2013.01)

(58) Field of Classification Search

CPC ..... F04D 17/08; F04D 17/10; F04D 17/16; F04D 25/06; F04D 25/0606; F04D 25/0613; F04D 25/08; F04D 29/40; F04D 29/403; F04D 29/42; F04D 29/4206; F04D 29/4213; F04D 29/4226; F04D 29/44; F04D 29/441; F04D 29/70; F04D 29/701; F04D 29/703; F04D 29/522; F04D 29/54; F04D 29/541

USPC ..... 417/423.14

See application file for complete search history.

(56) References Cited

U.S. PATENT DOCUMENTS

| | | | | |
|---|---|---|---|---|
| 6,460,608 | B1 | 10/2002 | Katsui | |
| 7,351,032 | B2 * | 4/2008 | Horng et al. | 415/213.1 |
| 7,744,341 | B2 * | 6/2010 | Hwang et al. | 415/102 |
| 7,909,571 | B2 | 3/2011 | Wu et al. | |
| 2004/0191057 | A1 * | 9/2004 | Lee et al. | F04D 29/703 415/121.1 |
| 2012/0269665 | A1 | 10/2012 | Takeshita et al. | |

FOREIGN PATENT DOCUMENTS

| | | |
|---|---|---|
| CN | 2665426 Y | 12/2004 |
| CN | 2849256 Y | 12/2006 |

* cited by examiner

*Primary Examiner* — Devon Kramer
*Assistant Examiner* — Chirag Jariwala
(74) *Attorney, Agent, or Firm* — Alan D. Kamrath; Kamrath IP Lawfirm, P.A.

(57) ABSTRACT

A blower fan includes a fan frame, a motor, an impeller and a shield. The fan frame includes a base plate portion, a cover plate portion, and a lateral wall portion arranged between the base plate portion and the cover plate portion. The cover plate portion includes an axial air inlet, and the lateral wall portion includes an air outlet. The motor is mounted in the fan frame. The impeller is rotatably coupled with the motor. The shield is coupled with the fan frame and has a face facing the axial air inlet. At least one lateral air inlet is formed between the cover plate portion and the shield. An air-guiding space is formed between the at least one lateral air inlet and the axial air inlet of the cover plate portion.

12 Claims, 7 Drawing Sheets

BLOWER FAN

BACKGROUND OF THE INVENTION

1. Field of the Invention

The present invention generally relates to a cooling fan and, more particularly, to a blower fan.

2. Description of the Related Art

Conventional cooling fans include axial-flow fans and blower fans. The axial-flow fan has an axial air inlet and an axial air outlet opposite to the axial air inlet. Air can be drawn into the fan via the axial air inlet and then expelled from the fan via the axial air outlet, achieving a desired cooling effect. The blower fan has an axial air inlet in an axial direction and a radial air outlet in a radial direction of the fan. Air can be drawn into the fan via the axial air inlet and then expelled from the fan via the radial air outlet for cooling purposes.

Since the axial-flow fan expels air only in the axial direction, the axial-flow fan must be mounted on the top of an electronic device to be cooled, such as a Central Processing Unit (CPU) of a computer. As a result, the height of the electronic device cannot be reduced.

In addition, since the blower fan is able to expel air via the radial air outlet, the blower fan does not have to be mounted on the top of the heat source. Advantageously, the blower fan can be installed in any kind of miniaturized electronic device with limited interior space. However, when the blower fan is installed in an electronic device, foreign debris (such as dust or water) may intrude into the fan via its axial air inlet, resulting in damage to the fan.

In light of this problem, Taiwan Patent No. 1330224 discloses a blower fan 9 as shown in FIG. 1. The blower fan includes a fan frame 91 having an axial air inlet 911 and a radial air outlet 912. Fan frame 91 receives an impeller 92 and a motor that is used to drive impeller 92 to rotate. When the motor drives impeller 92 to rotate, air can be drawn into the fan via axial air inlet 911 and expelled from the fan via radial air outlet 912, achieving a desired cooling effect.

In blower fan 9, a barrier 93 is arranged along a periphery of axial air inlet 911. In this arrangement, although barrier 93 is able to prevent the foreign debris or liquid from intruding into fan 9 in a lateral direction of the axial air inlet 911, the foreign debris or liquid from above fan 9 may still intrude into fan 9 via axial air inlet 911, resulting in damage to fan 9. Furthermore, when a user installs fan 9 into an electronic device by his/her hands, the user is liable to accidentally touch impeller 92 through axial air inlet 911, resulting in damage to fan 9 and causing inconvenience during the installation of fan 9. In addition, the user's fingers may be hurt when accidentally touching impeller 92 during the rotation of impeller 92. Disadvantageously, safety of fan 9 is poor.

SUMMARY OF THE INVENTION

It is therefore the objective of this invention to provide a blower fan which prevents foreign debris or liquid above an axial air inlet of the fan from intruding into the fan. Thus, damage to the fan can be prevented.

It is another objective of this invention to provide a blower fan which prevents the user from sticking his/her fingers into the fan via an axial air inlet of the fan. Thus, safety of the fan is improved.

In an embodiment of the invention, a blower fan including a fan frame, a motor, an impeller and a shield is disclosed. The fan frame comprises a base plate portion, a cover plate portion, and a lateral wall portion arranged between the base plate portion and the cover plate portion. The cover plate portion comprises an axial air inlet, and the lateral wall portion comprises an air outlet. The motor is mounted in the fan frame. The impeller is rotatably coupled with the motor. The shield is coupled with the fan frame and has a face facing the axial air inlet. At least one lateral air inlet is formed between the cover plate portion and the shield. An air-guiding space is formed between the at least one lateral air inlet and the axial air inlet of the cover plate portion.

In a preferred form shown, the at least one lateral air inlet comprises a plurality of lateral air inlets. The blower fan further includes a plurality of coupling members arranged along a periphery of the axial air inlet. The plurality of coupling members is spaced from each other to form the plurality of lateral air inlets therebetween. The shield comprises a plurality of through-holes corresponding to the plurality of coupling members. The blower fan further includes a plurality of fixing members extending through the plurality of through-holes to fix the shield to the plurality of coupling members.

In the preferred form shown, the at least one lateral air inlet includes a single lateral air inlet. A side wall is formed along a periphery of the shield. The side wall includes an opening serving as the lateral air inlet. The shield is affixed to the cover plate portion.

In the preferred form shown, the at least one lateral air inlet includes a single lateral air inlet. A fixed side wall is arranged along a periphery of the axial air inlet. The fixed side wall includes an opening serving as the lateral air inlet. The shield is affixed to the fixed side wall.

In the preferred form shown, the cover plate portion includes an inner face and an outer face opposite to the inner face. The inner face faces the base plate portion, and the outer face faces away from the base plate portion. An air inlet side is formed above the axial air inlet, and the shield is disposed at the air inlet side.

In the preferred form shown, the blower fan has a total height and an upper height. The total height is a distance between a bottom face of the base plate portion and a top face of the shield along an axial direction of the blower fan, and the upper height is a distance between an outer face of the cover plate portion and a bottom face of the shield along the axial direction of the blower fan. The upper height is 12.5% to 75% of the total height.

In the preferred form shown, the upper height is 25% to 50% of the total height. Alternative, the upper height is 37.5% of the total height.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
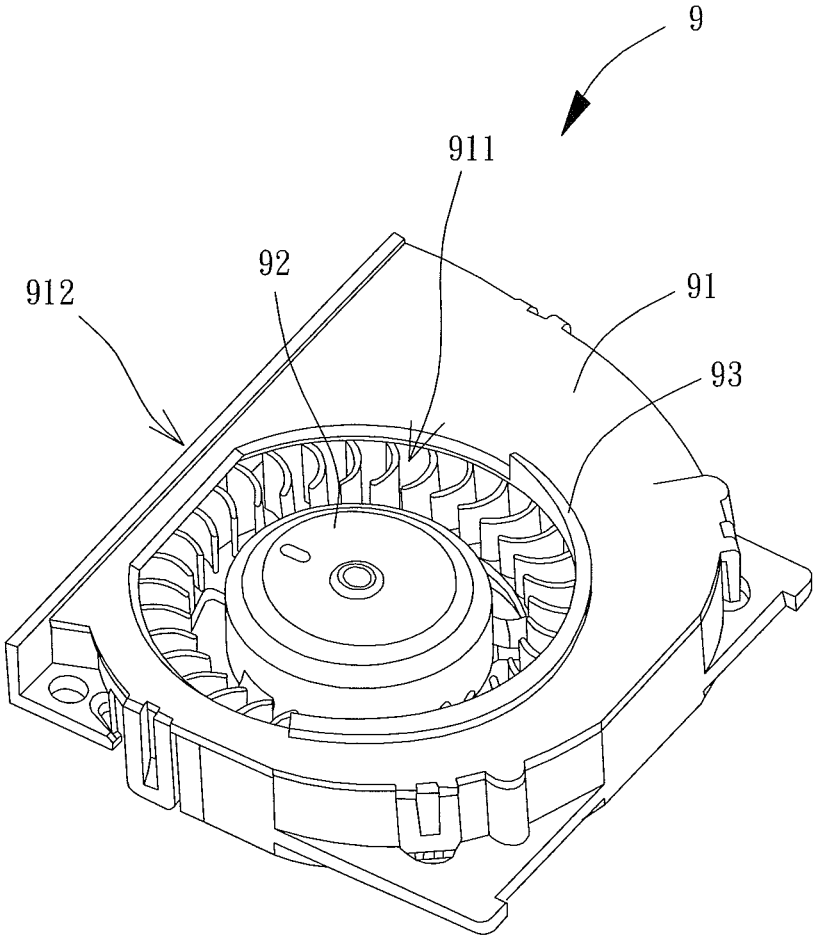
FIG. 1 PRIOR ART
FIG. 1 shows a conventional blower fan.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
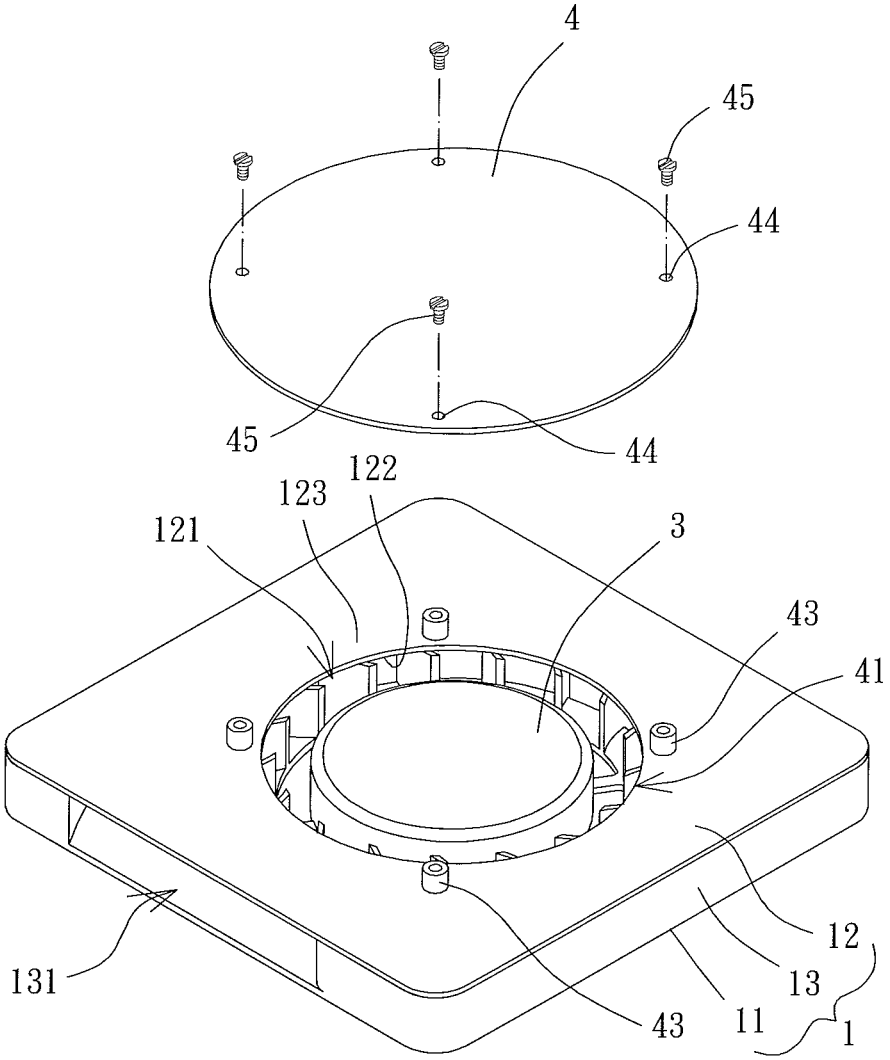
FIG. 2 is an exploded view of a blower fan according to a first embodiment of the invention.
Figure 3:
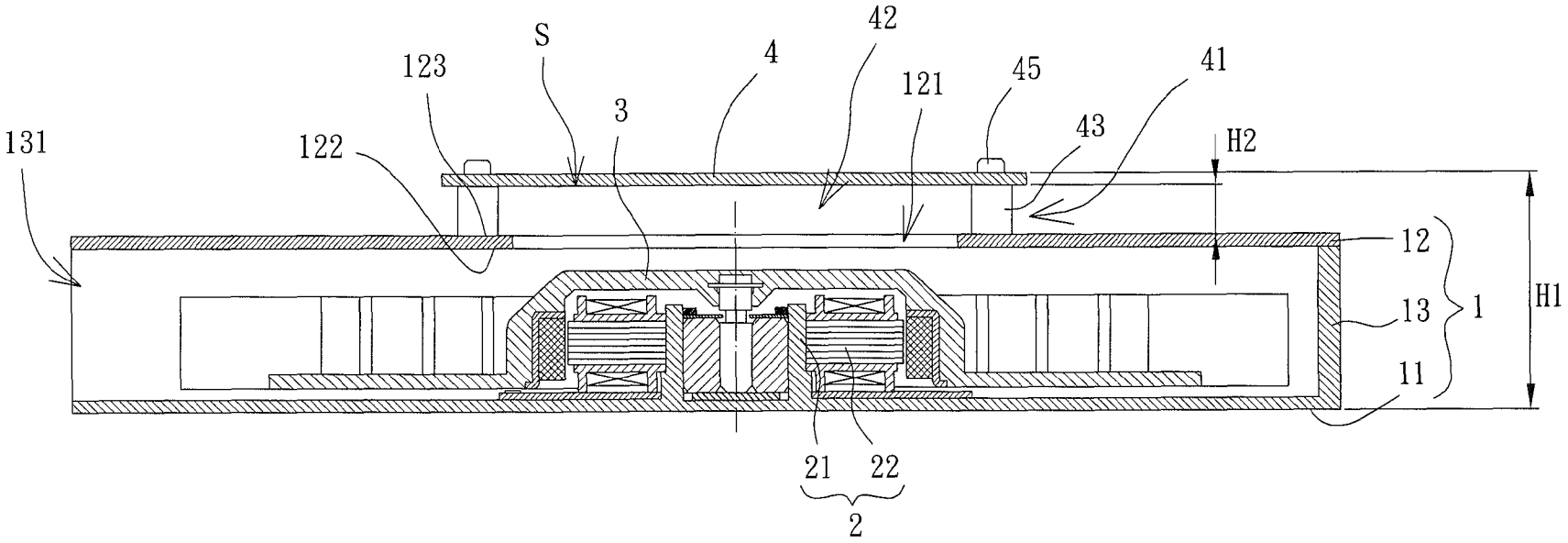
FIG. 3 is a cross-sectional view of the blower fan of the first embodiment of the invention.

FIGS. 2 and 3 show a blower fan according to a first embodiment of the invention. The blower fan includes a fan frame 1, a motor 2, an impeller 3 and a shield 4. Air can be guided into and out of fan frame 1. Motor 2 is installed in fan frame 1. Impeller 3 is rotatably coupled with motor 2, so that motor 2 is able to drive impeller 3 to rotate. Shield 4 is coupled with fan frame 1 to prevent foreign debris or liquid from intruding into fan frame 1.

Fan frame 1 is of any hollow frame structure capable of receiving motor 2 and impeller 3. Air can flow into the frame structure in an axial direction and flow out of the frame structure in a radial direction. The frame structure may have various geometric shapes, such as a polygonal shape, a round shape, an oval shape, etc. In this embodiment, fan frame 1 has a rectangular shape.

Fan frame 1 includes a base plate portion 11 and a cover plate portion 12 spaced from base plate portion 11 by a distance. The distance allows a lateral wall portion 13 to be arranged between base plate portion 11 and cover plate portion 12. Base plate portion 11, cover plate portion 12 and lateral wall portion 13 can be coupled with each other in any manner without limitations. In this embodiment, lateral wall portion 13 is integrally formed on an outer periphery of base plate portion 11 in injection molding. Cover plate portion 12 is in the form of a cover plate that can be affixed to and detached from lateral wall portion 13.

Cover plate portion 12 further includes an axial air inlet 121. Referring to FIG. 3, cover plate portion 12 includes an inner face 122 and an outer face 123. Inner face 122 faces base plate portion 11, and outer face 123 faces away from base plate portion 11. An air inlet side S is formed above axial air inlet 121. Lateral wall portion 13 includes an air outlet 131. In this arrangement, a fan frame of a blower fan is formed. Fan frame 1 may include more than one axial air inlet 121 and air outlet 131 based on different requirements, and their locations can be changed as desired.

Motor 2 is disposed between base plate portion 11 and cover plate portion 12 in fan frame 1. Motor 2 can be of any structure capable of driving impeller 3 to rotate when coupled with impeller 3. Referring to FIG. 3, motor 2 includes a shaft seat 21 and a coil unit 22. Shaft seat 21 can be affixed to or integrally formed on base plate portion 11 of fan frame 1. Coil unit 22 (which may include components such as a plurality of silicon steel plates, a coil, an insulation bobbin, etc) surrounds shaft seat 21 and is electrically connected to a driving circuit (not shown), thus driving impeller 3 to rotate.

Impeller 3 is rotatably coupled with motor 2. In this embodiment, impeller 3 is rotatably coupled with shaft seat 21 of motor 2. Preferably, impeller 3 is completely received in fan frame 1.

Shield 4 is coupled with fan frame 1 and located above axial air inlet 121. As shown in FIG. 3, at least one lateral air inlet 41 is formed between cover plate portion 12 and shield 4. An air-guiding space 42 is formed between lateral air inlet 41 and axial air inlet 121 of cover plate portion 12. In this embodiment, shield 4 is disposed at air inlet side S above fan frame 1, preventing foreign debris from intruding into fan frame 1 via axial air inlet 121. More importantly, although shield 4 is disposed at air inlet side S above axial air inlet 121, air is still able to flow into fan frame 1 via lateral air inlet 41, air-guiding space 42 and axial air inlet 121 in order, achieving a desired cooling effect.

More specifically, shield 4 can be coupled with fan frame 1 in many ways as described below.

In the first example shown in FIGS. 2 and 3, a plurality of coupling members 43 may be arranged along a periphery of axial air inlet 121. The plurality of coupling members 43 is spaced from each other, so that a plurality of lateral air inlets 41 may be formed therebetween. As such, air can flow into the blower fan in many ways, improving the intake air capacity of the fan. Based on the arrangement of coupling members 43, shield 4 may have a plurality of through-holes 44 having the same quantity as coupling members 43. In this regard, a plurality of fixing members 45 (such as screws) may be extended through the plurality of through-holes 44 to fix shield 4 to the plurality of coupling members 43. In this arrangement, shield 4 is positioned above axial an inlet 121 at air inlet side S to form the plurality of lateral air inlets 41 and air-guiding space 42 between shield 4 and cover plate portion 12.

Figure 4:
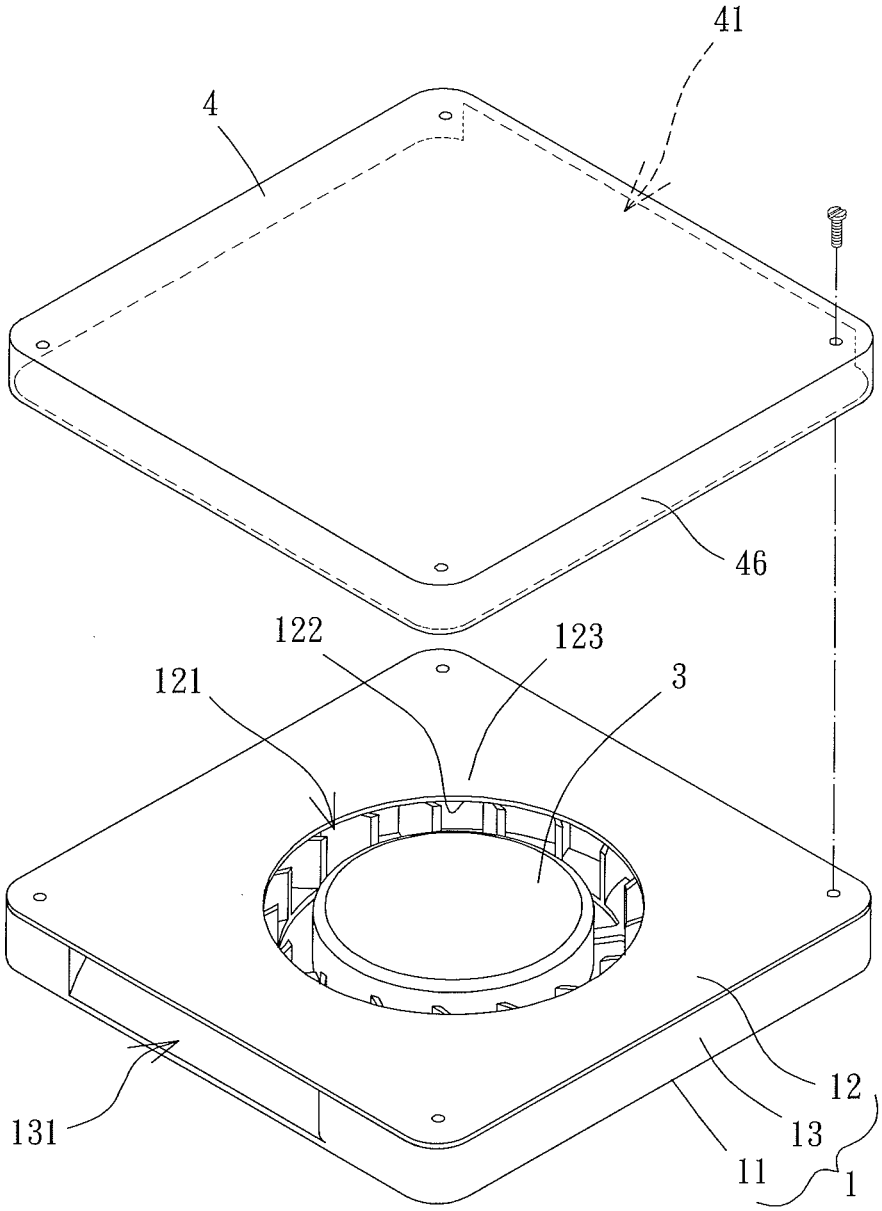
FIG. 4 is an exploded view of a blower fan according to a second embodiment of the invention.
Figure 5:
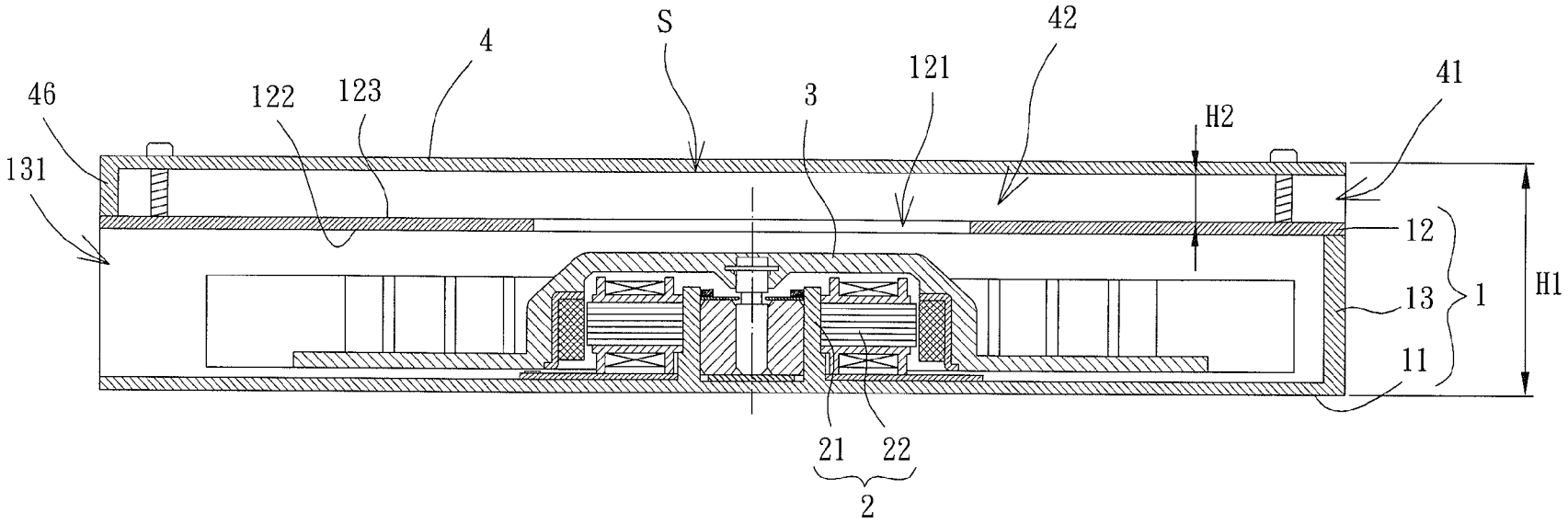
FIG. 5 is a cross-sectional view of the blower fan of the second embodiment of the invention.

In the second example shown in FIGS. 4 and 5, a side wall 46 may be formed along a periphery of shield 4. Side wall 46 may have an opening serving as lateral air inlet 41. In this arrangement, shield 4 may be affixed to cover plate portion 12 via side wall 46 by ways of, for example, welding, fastening, adhesion, screwing, etc. In this embodiment, shield 4 is affixed to cover plate portion 12 by way of screwing, thereby positioning shield 4 at air inlet side S above axial air inlet 121 of fan frame 1 and forming lateral air inlet 41 and air-guiding space 42 between shield 4 and cover plate portion 12.

Figure 6:
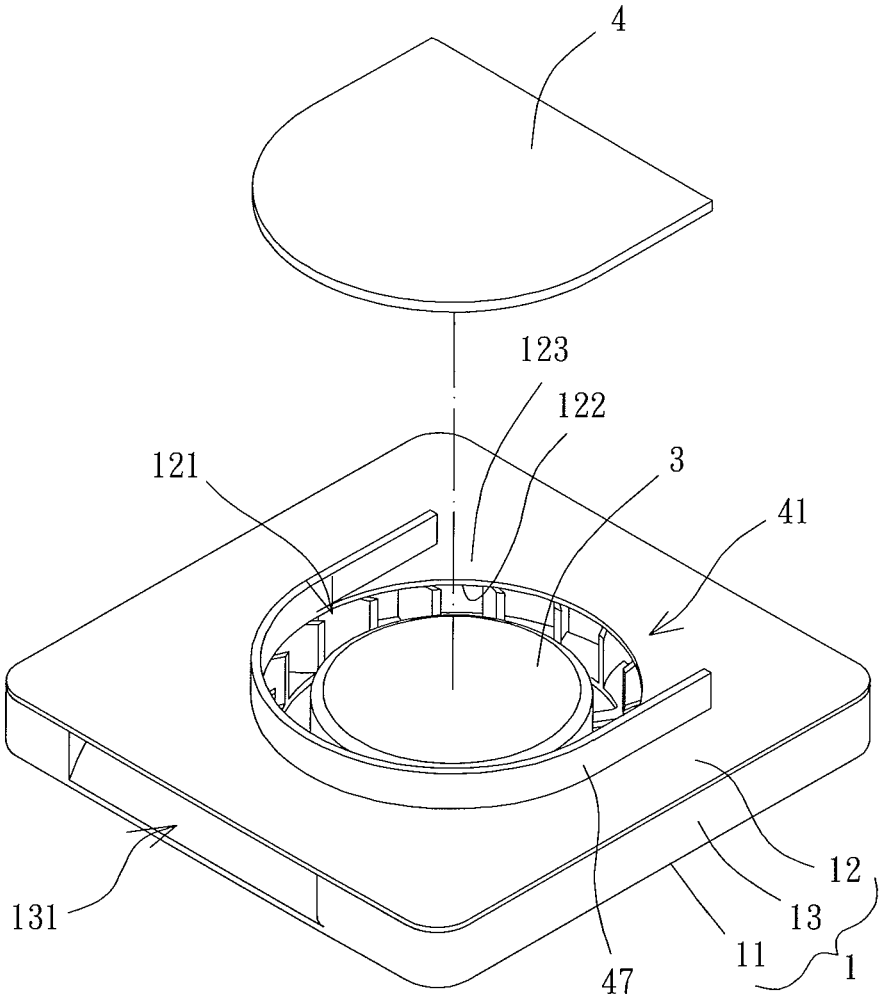
FIG. 6 is an exploded view of a blower fan according to a third embodiment of the invention.
Figure 7:
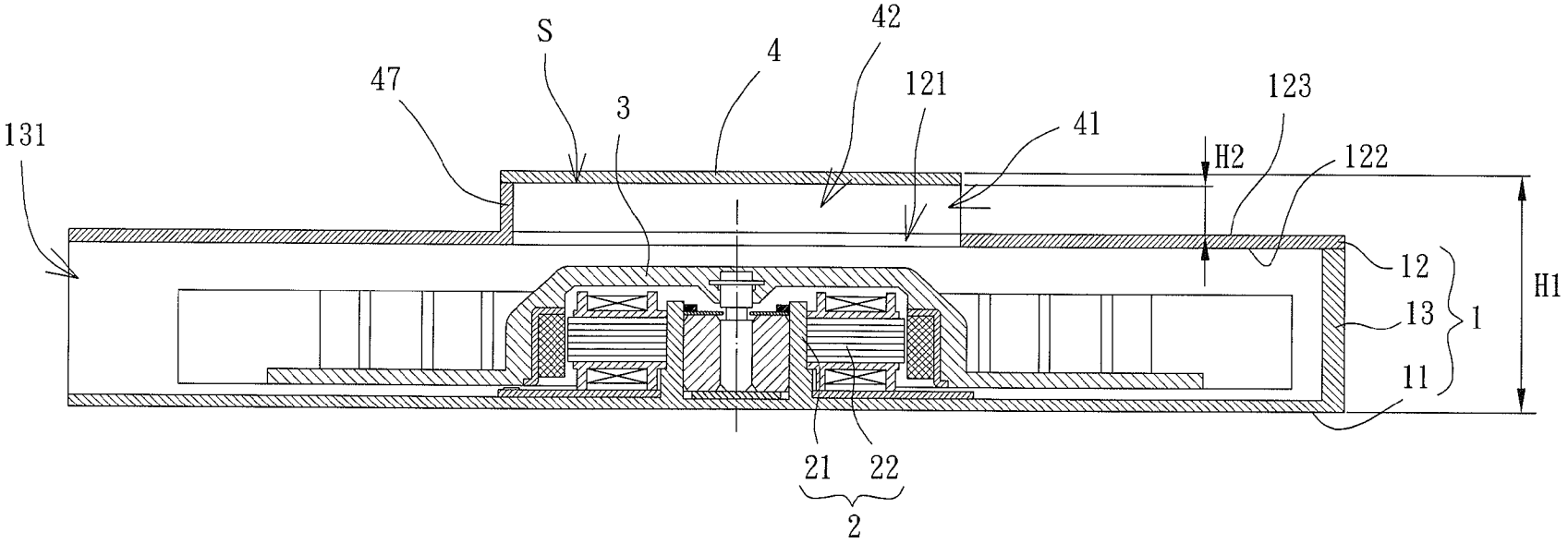
FIG. 7 is a cross-sectional view of the blower fan of the third embodiment of the invention.

In the third example shown in FIGS. 6 and 7, a fixed side wall 47 may be arranged along the periphery of axial air inlet 121 of fan frame 1. Fixed side wall 47 has an opening serving as lateral air inlet 41. In this arrangement, shield 4 may be affixed to fixed side wall 47 by ways of, for example, welding, fastening, adhesion, screwing, etc. Therefore, shield 4 can be positioned above axial air inlet 121 at air inlet side S when lateral air inlet 41 and air-guiding space 42 are formed between shield 4 and cover plate portion 12.

Based on the embodiments shown in FIGS. 2 to 7 above, the blower fan preferably has a total height H1 and an upper height H2. Total height H1 is the distance between a bottom face of base plate portion 11 and a top face of shield 4 along an axial direction of the blower fan. Upper height H2 is the distance between outer face 123 of cover plate portion 12 and a bottom face of shield 4 along the axial direction of the blower fan (which is the height of lateral air inlet 41). In this arrangement, upper height H2 may be 12.5% to 75% of total height H1. Preferably, upper height H2 is 25% to 50% of total height H1. In a more preferred situation, upper height H2 is 37.5% of total height H1. Based on the above features, it can be ensured that upper height H2 of lateral air inlet 41 will not occupy a large percentage of total height H1 when air can be guided through lateral air inlet 41. Advantageously, the thickness of the fan can be reduced, and the cooling effect of the fan can be improved.

During the operation of the blower fan, impeller 3 may be driven to rotate when the alternating magnetic fields generated by coil unit 22 of motor 2 drives a permanent magnet of impeller 3 to rotate. The principle on how motor 2 drives impeller 3 to rotate, as well as the detailed structures of motor 2 and impeller 3, are not described herein, as it can be readily appreciated by one having ordinary skill in the art. During the rotation of impeller 3, air can be drawn into air-guiding space 42 via lateral air inlet 41, and then further guided into fan frame 1 via axial air inlet 121. Finally, the air in fan frame 1 is guided to a predetermined heat source via air outlet 131. Thus, the blower fan can be installed in any kind of electronic device to provide the desired cooling effect for the heat source.

In the above embodiments of the invention, shield 4 is arranged above axial air inlet 121 to effectively prevent foreign debris or liquid from intruding into fan frame 1 via axial air inlet 121. As such, damage to the blower fan can be prevented. Furthermore, shield 4 is also able to prevent the user from accidentally pressing impeller 3, as well as preventing the user from getting injured resulting from the user accidentally touching impeller 3 with his/her fingers, achieving an improved safety mechanism.

Furthermore, it can be ensured that impeller 3 is able to smoothly draw air into fan frame 1 via lateral air inlet 41 and air-guiding space 42 in a lateral direction due to the arrangement of lateral air inlet 41 and air-guiding space 42 formed between shield 4 and cover plate portion 12. Based on this, although shield 4 is arranged right above axial air inlet 121, a basic cooling function can be provided. Moreover, based on the arrangement of lateral air inlet 41 and air-guiding space 42, air can be drawn into fan frame 1 in a lateral direction. This allows the blower fan of the invention to be applied to any kind of electronic device with lateral air inlet(s), such as cellular phones, personal digital assistants, notebook computers, etc. Advantageously, utility of the blower fan is improved.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A blower fan comprising:

a fan frame comprising a base plate portion, a cover plate portion, and a lateral wall portion arranged between the base plate portion and the cover plate portion, wherein the cover plate portion comprises an axial air inlet and the lateral wall portion comprises an air outlet;

a motor mounted in the fan frame;

an impeller located intermediate the base and cover plate portions and rotatably coupled about an axis with the motor, with the impeller having cross sections perpendicular to the axis and having an outer periphery; and a shield coupled with the fan frame and having a face facing the axial air inlet and having an outer periphery, with the cover plate portion being intermediate and spaced from the shield and the base plate portion, with the outer periphery of the shield located radially inside and spaced from the outer periphery of the impeller, with the face being solid inside the outer periphery to prevent a liquid from intruding into the fan frame, wherein at least one lateral air inlet is formed between the cover plate portion and the shield, and wherein an air-guiding space is formed between the at least one lateral air inlet and the axial air inlet of the cover plate portion, wherein the blower fan has a total height and an upper height, wherein the total height is a distance between a bottom face of the base plate portion and a top face of the shield along an axial direction of the blower fan, wherein the upper height is a distance between an outer face of the cover plate portion and a bottom face of the shield along the axial direction of the blower fan, and wherein the upper height is 12.5% to 75% of the total height.

2. The blower fan as claimed in claim 1, wherein the at least one lateral air inlet comprises a single lateral air inlet, wherein a side wall is formed along the outer periphery of the shield, wherein the side wall comprises an opening serving as the lateral air inlet, and wherein the shield is affixed to the cover plate portion.

3. The blower fan as claimed in claim 1, wherein the at least one lateral air inlet comprises a single lateral air inlet, wherein a fixed side wall is arranged along a periphery of the axial air inlet, wherein the fixed side wall comprises an opening serving as the lateral air inlet, and wherein the shield is affixed to the fixed side wall.

4. The blower fan as claimed in claim 1, wherein the cover plate portion comprises an inner face and an outer face opposite to the inner face, wherein the inner face faces the base plate portion, wherein the outer face faces away from the base plate portion, wherein an air inlet side is formed above the axial air inlet, and wherein the shield is disposed at the air inlet side.

5. The blower fan as claimed in claim 1, wherein the upper height is 25% to 50% of the total height.

6. The blower fan as claimed in claim 5, wherein the upper height is 37.5% of the total height.

7. The blower fan as claimed in claim 1, wherein the lateral wall portion has cross sections parallel to the base and cover plate portions and having a size; wherein the shield has cross sections parallel to the base and cover plate portions and having a size smaller than the size of the cross sections of the lateral wall portion; and wherein the axial air inlet has cross sections parallel to the base and cover plate portions and having a size smaller than the size of the cross sections of the shield.

8. The blower fan as claimed in claim 7, wherein the axial air inlet has a periphery with cross sections parallel to the base and cover plate portions and having a shape; and wherein the outer periphery of the shield has cross sections parallel to the base and cover plate portions and having a same shape as the shape of the periphery of the axial air inlet.

9. The blower fan as claimed in claim 8, wherein the periphery of the axial air inlet is concentrically within the outer periphery of the shield.

10. The blower fan as claimed in claim 9, wherein the shield is within and spaced from the lateral wall portion parallel to the base and cover plate portions.

11. The blower fan as claimed in claim 10, wherein the shape of the periphery of the axial air inlet is circular, and wherein the lateral wall portion has square cross sections parallel to the base and cover plate portions.

12. The blower fan as claimed in claim 11, wherein the at least one lateral air inlet comprises a plurality of lateral air inlets, and wherein the blower fan further comprises:

a plurality of coupling members extending from the cover plate portion away from the base plate portion concentrically around the periphery of the axial air inlet, with the outer periphery of the shield located intermediate and spaced from the lateral wall portion and the plurality of coupling members, wherein the plurality of coupling members is spaced from each other to form the plurality of lateral air inlets therebetween, and wherein the shield comprises a plurality of through-holes corresponding to the plurality of coupling members; and a plurality of fixing members extending through the plurality of through-holes to fix the shield to the plurality of coupling members.

* * * * *